United States Patent [19]

Peterson

[11] 4,039,433

[45] Aug. 2, 1977

[54] PROCESS AND APPARATUS FOR RECOVERING METAL FROM SOIL

[75] Inventor: Francis C. Peterson, St. Louis City, Mo.

[73] Assignee: C. Hager & Sons Hinge Manufacturing Company, St. Louis, Mo.

[21] Appl. No.: 648,127

[22] Filed: Jan. 12, 1976

[51] Int. Cl.[2] ..... B03B 5/66

[52] U.S. Cl. ..... 209/3; 209/10; 209/161; 209/211; 209/24

[58] Field of Search ..... 209/3, 10, 18, 158–161, 209/211, 208; 241/20, 24; 210/521, 513, 534

[56] References Cited

U.S. PATENT DOCUMENTS

| | | | |
|---|---|---|---|
| 806,414 | 12/1905 | Krause | 209/160 |
| 1,456,563 | 5/1923 | Noriega | 209/161 |
| 2,207,218 | 7/1940 | Forman | 209/158 |
| 2,417,660 | 3/1947 | Remick | 209/18 X |
| 3,024,909 | 3/1962 | Dahlstrom | 209/211 |
| 3,035,697 | 5/1962 | Koch | 209/161 |

FOREIGN PATENT DOCUMENTS

| | | | |
|---|---|---|---|
| 1,166,111 | 3/1964 | Germany | 209/3 |

*Primary Examiner*—Frank W. Lutter
*Assistant Examiner*—Ralph J. Hill
*Attorney, Agent, or Firm*—Gravely, Lieder & Woodruff

[57] ABSTRACT

Metal contained within soil is separated therefrom by introducing the soil into a tank containing water which is quite turbulent, the turbulence being generated by the fact that the water is introduced into the tank in a swirl and also directly upwardly through the center of the swirl. Vibrator units on the sidewalls of the tank further add to the turbulence. Upon being introduced into the turbulent water, the soil quickly turns to mud which goes into suspension and the suspension so formed is buoyed upwardly by the incoming clean water which rises through the tank. The suspension overflows the tank and is directed to a settling basin where the mud is allowed to settle out. The clean water which remains is recirculated through the tank. The metal, on the other hand, being considerably heavier than the mud, passes downwardly through the tank where it is thoroughly washed by the incoming water. The washed metal passes out of the bottom of the tank and is elevated upwardly by a screw-type conveyor.

15 Claims, 5 Drawing Figures

PROCESS AND APPARATUS FOR RECOVERING METAL FROM SOIL

BACKGROUND OF THE INVENTION

This invention relates in general to the recovery of metal, and more particularly to a process and apparatus for recovering metal from soil.

A substantial market exists for scrap lead and one largely unexploited source of such lead is the ranges of gun clubs, particularly the ranges of those clubs which specialize in trap shooting. Over the course of years considerable lead is expended at these clubs, it being in the form of shot discharged from shotgun shells. This shot lies in a band located between 200 and 300 yards from the firing position, and may be buried as deep as 6 inches.

Heretofore, lead shot has been successfully recovered from relatively loose or sandy soils, but only at great expense and considerable difficulty. Moreover, the lead is relatively dirty and must be washed. Efforts to recover lead shot from soils containing a substantial amount of clay or highly compacted top soil have met with little success.

SUMMARY OF THE INVENTION

One of the principal objects of the present invention is to provide a process and apparatus which recovers metal from soil, particularly soils which are highly compacted such as clay. Another object is to provide a process and apparatus of the type stated which is economical. A further object is to provide a process of the type stated which is particularly useful for recovery of lead shot from the ranges of gun clubs. An additional object is to provide a process of the type stated in which the recovered metal is washed. Still another object is to provide an apparatus of the type stated which is relatively simple in construction and highly durable. These and other objects and advantages will become apparent hereinafter.

The present invention is embodied in a process which includes mixing soil containing metal with water so as to convert the soil to mud, maintaining the mud in suspension within the water while allowing the metal to gravitate through the water, and thereafter removing the metal from the water. It is also embodied in an apparatus including a tank, means for introducing water into the tank such that turbulence is created, and means at the bottom of the tank for conveying the metal which gravitates downwardly away from the bottom of the tank. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

As previously noted a considerable amount of lead shot exists at gun clubs, it being usually located in a band about 100 yards wide. The lead shot may be buried to 6 inches, although most of it is at a lesser depth. Where the soil is highly compacted such as clay, the soil tends to cling to the shot and the two are extremely difficult to separate.

Figure 1:
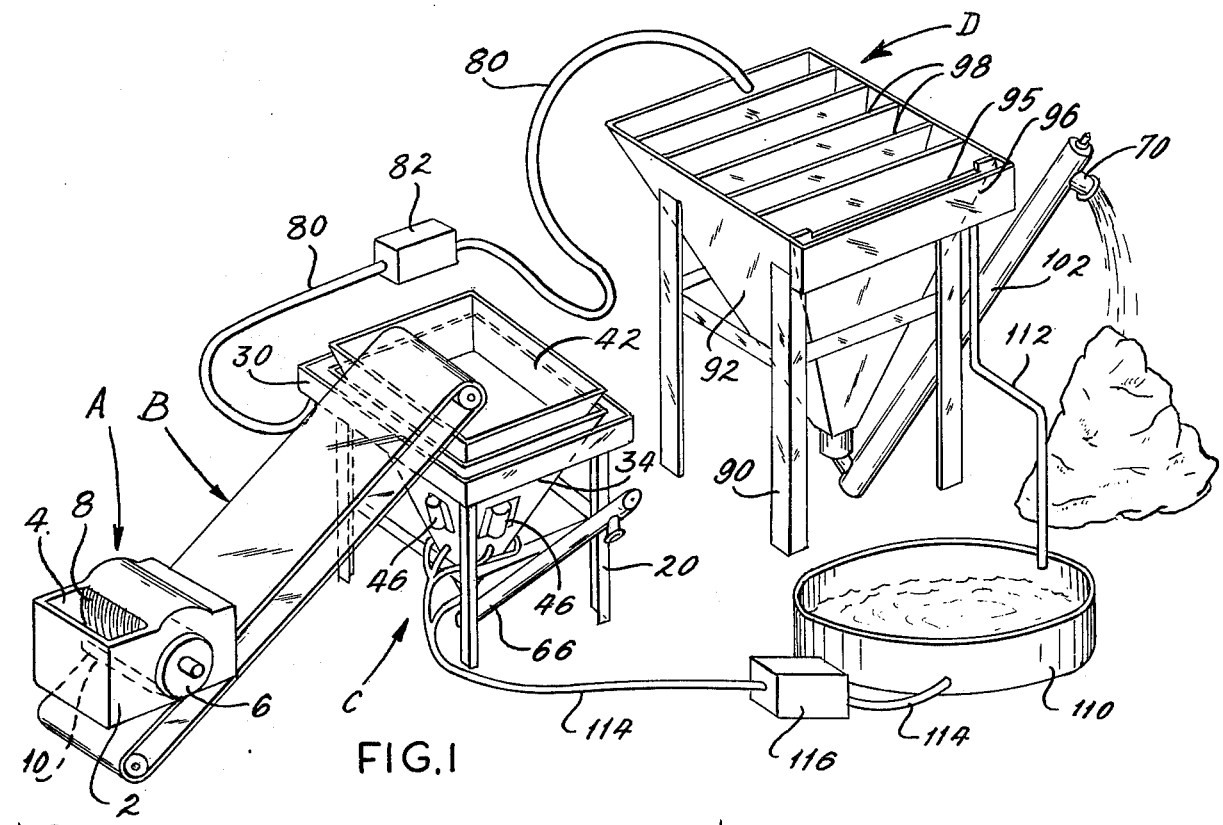
FIG. 1 is a perspective view of the apparatus for performing the process of the present invention.

The first step in the process of the present invention is collecting the soil containing the lead shot. This may be achieved by removing the top six inches of soil with a conventional scraper which is a large piece of earth moving equipment. The scraper of course is operated only over the 100 yard band in which the shot lies. The soil stripped by the scraper is delivered to an earth shredder A (FIG. 1) which resembles a conventional shredding machine. The rotating knives or hammers of the shredder A reduce the soil to a relatively small size and break up any large clumps. The shredder A discharges the shredded soil downwardly where it falls onto a conveyor B which transports the soil to a lead separator C.

Within the separator C the soil is mixed with relatively turbulent water so that the soil is quickly converted into mud which is maintained in suspension. Clean water is continually forced into the separator C from the bottom thereof and this flow of clean water buoys the suspended mud upwardly and indeed causes it to overflow the lead separator C. The lead shot, being considerably denser than the soil, gravitates downwardly through the incoming clean water and is collected. As the shot passes through clean water it is thoroughly washed so that the shot which is collected is entirely free of the soil. The recovered lead shot may be reused in shot gun shells or sold as lead scrap.

The soil or mud suspension which overflows the lead separator is directed to a settling basin D (FIG. 1) where the mud settles out and is thereafter pumped to a mud pile. This mud may be returned to the range to replace the soil previously stripped away, or it may be used for other purposes such as land fill. The water overflows the settling basin D and is pumped back to the lead separator C where it is utilized as the clean water supply. In other words, the same water is circulated between the settling basin D and the lead separator C so a continuous supply of fresh water is not necessary.

The earth shredder A is conventional and includes (FIG. 1) a housing 2 provided with an upwardly opening inlet 4. The housing 2 contains a rotor 6 provided with knives or hammers 8 which move past the inner end of the inlet 4 and thereafter past by a grate 10 in the bottom of the housing 2. The shot-bearing soil which is collected by the scraper is dumped into the inlet 4 of the shredder A and thereupon falls into the paths of the rapidly revolving knives 8 which reduce the soil to a relatively fine composition. All of the soil discharged from the shredder A should pass a ½ inch screen. The reduced or shredded soil drops into the conveyor B which delivers it to the lead separator C.

Figure 2:
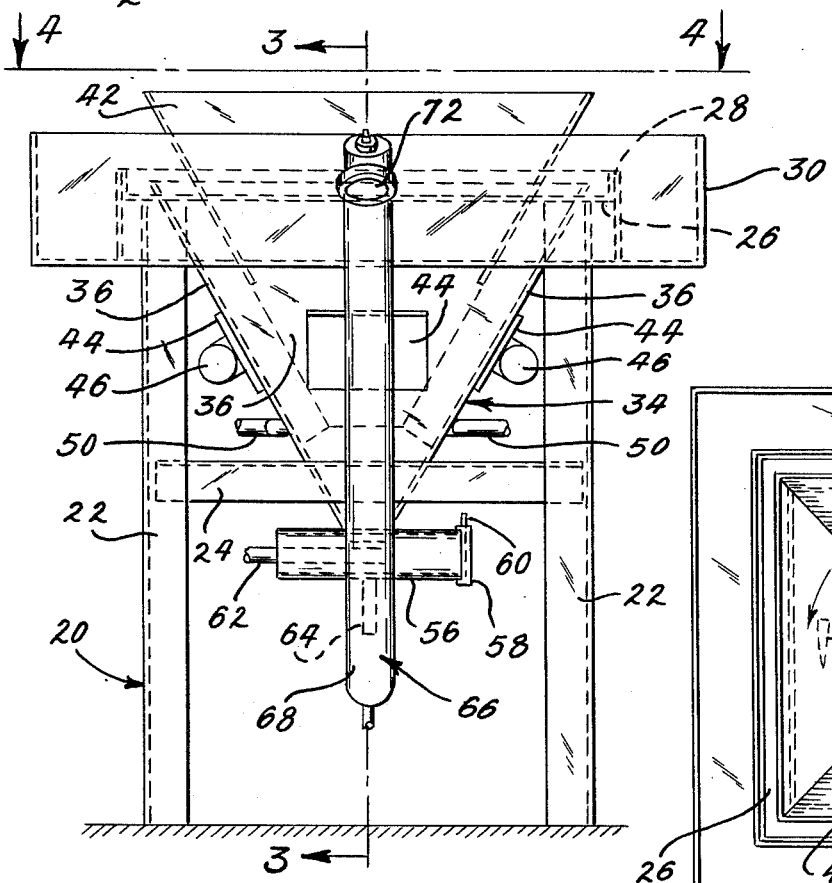
FIG. 2 is an elevational view of a metal separator forming part of the apparatus.
Figure 3:
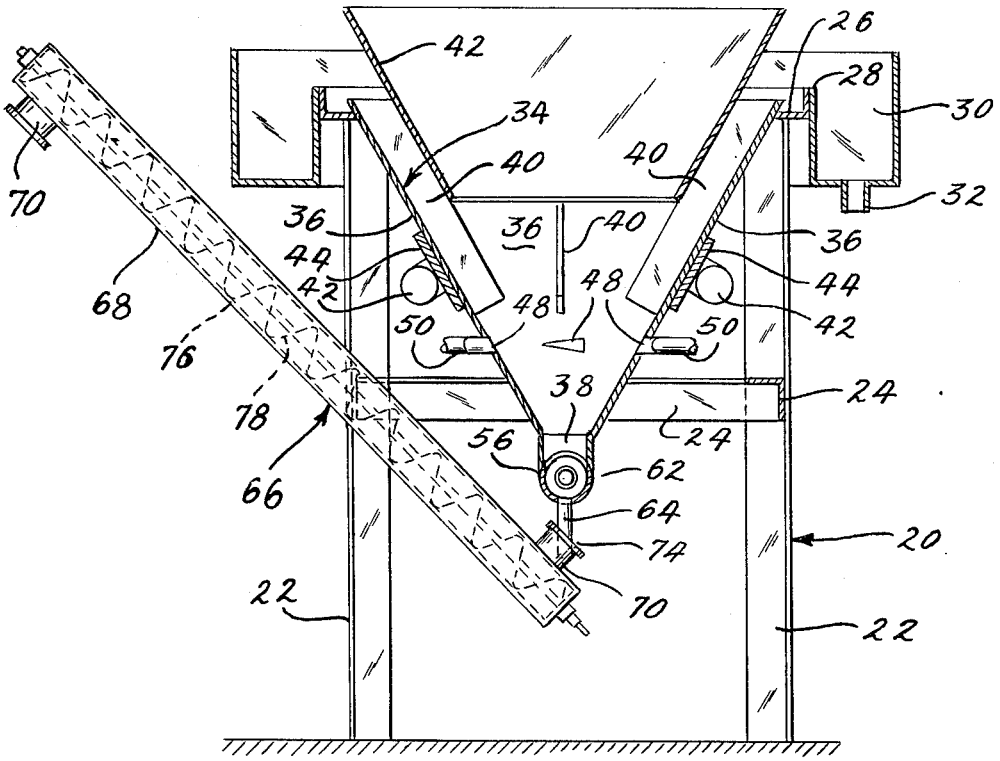
FIG. 3 is a sectional view of the metal separator taken along line 3—3 of FIG. 2.

The lead separator C includes (FIGS. 2–4) an upright frame 20 having four legs 22 which form the corners of the frame 20, and these legs are connected approximately midway between their ends by horizontal intermediate members 24. The upper ends of the legs 22 are, on the other hand, connected by horizontal top members 26 which may be lengths of angle iron. In any event, the top members form a lip of wier 28 around the upper end of the frame 20. Attached to the top members 26 is collecting trough 30, the bottom of which is somewhat below the top edge of the wier 28 so that any water which flows over the wier 28 will cascade into the trough 30 where it will collect. The outer wall of the trough 30 extends upwardly to a slightly greater elevation than upper surface of the weir 28. The trough 30 has a discharge spout 32 (FIG. 3) in the bottom thereof.

The frame 20 supports an agitating tank 34 (FIGS. 2 and 3) which possesses the shape of an inverted pyramid and is formed by four generally triangular walls 36 joined together at their sides. The walls 36 converge downwardly and terminate at an opening 38 (FIGS. 3 and 4) located slightly below the four horizontal intermediate members 24. The upper ends of the walls 36 are welded or otherwise securely fastened to the horizontal top members 26, with their upper edges slightly below the upper edge of the weir 28. Moreover, the connection is watertight so that water will not flow between the walls 36 and the top members 26 to which they are connected. Each wall 36 has a gusset 40 welded to it midway between its sides. The gussets 40 have their lower ends somewhat above the opening 38 and extend upwardly to the upper edge of the wall 36.

The gussets 40 support an inlet funnel 42 which, like the agitating tank 34, is in the shape of a truncated pyramid. Indeed, the funnel 42, while being truncated to a considerably greater extent that the tank 34, nevertheless possesses the same cross-sectional size and shape as the tank 36. Since the gussets 40 space the walls of the funnel 42 inwardly from the walls 36, the upper end of the funnel 42 is disposed at a higher elevation than the upper edge of the tank 34. In fact, the upper edge of the funnel 42 is located higher than the weir 28 and the outer wall of the trough 30 which surrounds it.

The outwardly presented surface of each wall 36 of the tank 34 has a relatively thick mounting plate 44 welded to it generally midway between its ends. Each plate 44 in turn has a vibrator unit 46 secured to it. The vibrator units 46 induce vibrations in the four walls 36 at a force of between 0 and 1,000 lbs. The frequency at which the vibrator units operate should be between 0 and 2,500 cycles per second. The four vibrators units 46 need not be synchronized nor need they even operate at the same frequency.

Figure 4:
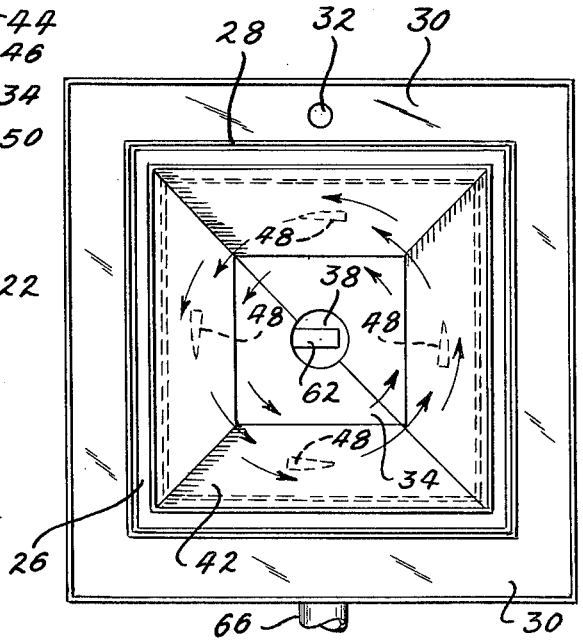
FIG. 4 is a top plan view of the metal separator.

Directly below their respective mounting plates 44 the triangular walls 36 of the agitating tank 34 are provided with orifices 48 (FIG. 3) which are elongated in the transverse or horizontal direction, and each orifice 48 forms the terminal end of a water supply pipe 50 to which pressurized clean water is supplied. The orifices 48 and the pipes 50 are configured and oriented such that the water is discharged generally horizontally, but nevertheless obliquely to the walls 36. Moreover, each orifice 48 discharges to the same side of the vertical centerline of the tank 34 so that the effect is to create swirl or whirlpool within the tank 34 (FIG. 4).

The opening 38 at the bottom of the agitating tank 34 opens into a horizontal cross pipe 56 (FIGS. 2 and 3) which is secured firmly to the lower end of the tank 34. The pipe 56 projects horizontally in both directions from the bottom of the tank 34 and at its one end is fitted with a rectangular frame 58 having opposed slots in which an adjustable clean out gate 60 is fitted. The gate 60 is normally in its lower position, but may be moved upwardly to expose the interior of the pipe 56. This provides access to the interior of the pipe 56 so that it may be cleaned. Extended into the other end of the cross pipe 56 is a smaller water supply pipe 62 which terminates within the interior of the cross pipe 56 slightly beyond the opening 38 at the bottom of the tank 34. Otherwise, that other end of the pipe 56 is sealed. Water furnished through the supply pipe 62 fills the interior of the cross pipe 56 and flows upwardly through the opening 38 in the bottom of the agitating tank 34 so as to create an upwardly directed flow of water through the interior of the tank 34.

Extended downwardly from the underside of the cross pipe 56 is a vertical discharge pipe 64 (FIG. 3) and that pipe communicates with the interior of the cross pipe 56 directly below the opening 38 in agitating tank 34.

The discharge pipe 64 leads to a screw-type conveyor 66 (FIG. 3) which extends upwardly at an oblique angle and projects from the frame 20 between two of the legs 22 thereof. The conveyor 66 includes a barrel 68 having an inlet port 70 at its lower end and an outlet spout 72 at its upper end. The discharge pipe 64 projects into the inlet port 70 where it is encircled by an elastomeric seal 74 which forms a watertight connection between the pipe 50 and the port 70. The discharge spout 72 is located above the upper edge of the weir 28 which surrounds the upper end of the agitating tank 34. Extended axially through the barrel 68 is a shaft 76, the ends of which project beyond the ends of the barrel 68 where suitable seals are provided to prevent leakage of water along the shaft 76. The shaft 76 is rotated by a suitable motor and carries an auger flight 78 which is located entirely within the barrel 68 and extends all the way from the inlet port 70 to the outlet spout 72.

The discharge spout 32 in the trough 30 surrounding the upper end of the agitating tank 34 is connected with a drain line 80 (FIG. 1) which leads to the settling basin D. The drain line 80 passes through a pump 82 which lifts the suspension upwardly to the upper end of the settling basin D, inasmuch as the settling basin D is somewhat higher than the lead separator C.

Figure 5:
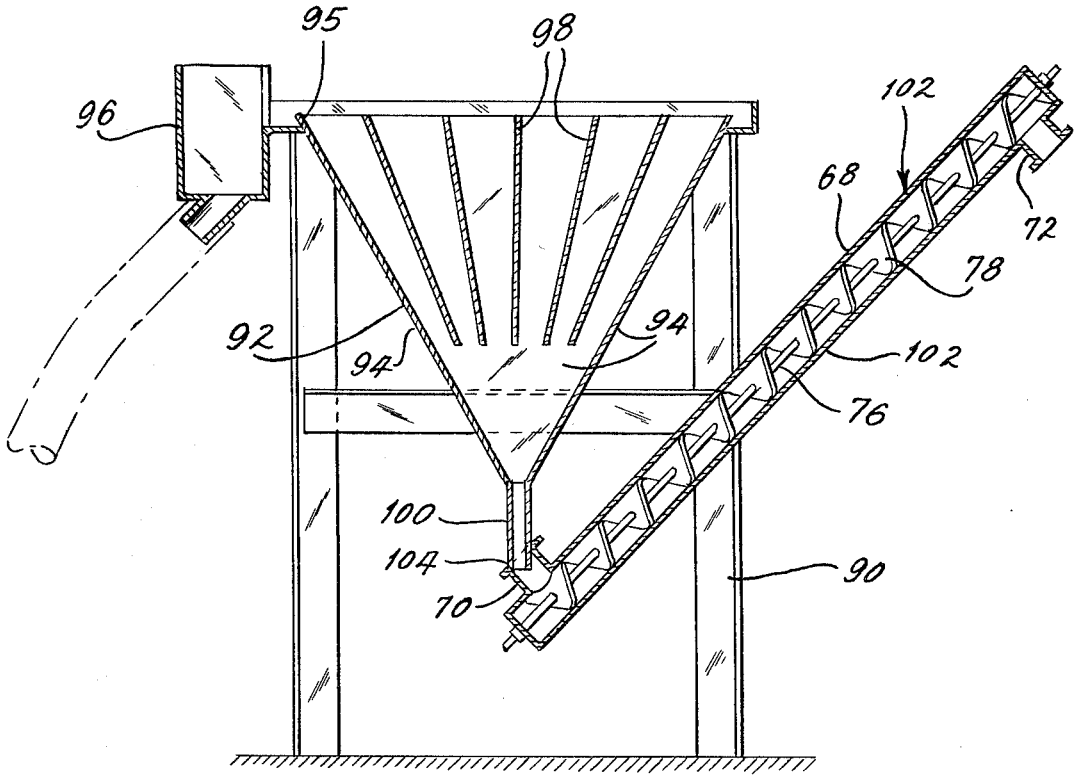
FIG. 5 is a sectional view of the settling basin which also forms part of the apparatus.

The settling basin D includes (FIG. 5) a frame 90 which supports a settling tank 92 having the shape of an pyramid, the base or large end of which is open and presented upwardly. Being a pyramid, the tank 92 has four generally triangular walls 96 which are welded together along their sides. The upper margin of one of the walls 94 has an elongated depression 95 so that it is slightly lower than the upper margins of the remaining walls 94 and adjacent to the depression 95 is an overflow trough 96 which is likewise mounted on the frame 90.

The drain line 80 opens into the settling tank 92 adjacent to the wall 94 opposite from the wall 94 along which the trough extends. Between these two walls 94 are a plurality of baffles 98 (FIG. 5) which traverse the interior of the tank 92 generally parallel to the trough 96. The baffles 98 are oriented generally vertically and have their upper margins located at the upper edges of the tank 92. Their lower margins however are spaced upwardly from the bottom of the tank 92 so that water may pass beneath the baffles 98. At the very bottom of the tank 92 where the four walls 94 converge, the tank 92 is provided with a discharge spout 100 which leads to a screwtype conveyor 102.

The conveyor 102 (FIG. 5) is similar in construction to the conveyor 66, and accordingly has a barrel 68 provided with an inlet port 70, and outlet spout 72, as well as a shaft having an auger flight 78. The discharge spout 100 of the tank 92 extends into the inlet port 70 of the conveyor 102 and an elastomeric seal 104 is provided at this location to prevent leakage. The outlet spout 72 is located above the upper edges of the walls 94 on the settling tank 92.

The overflow trough 96 is connected with a storage tank 100 (FIG. 1) through a drain line 112 so that water which flows over the depression 95 on the sidewall 94 adjacent to the overflow trough 96 will collect in the storage tank 110. The storage tank 110 is in turn connected through a supply line 114 to the several supply pipes 50 and 62 of the lead separator C. The supply line 114 has a pump 116 in it.

OPERATION

The earth shredder A and conveyor B, the lead separator C and the settling basin D are all utilized in conjunction for recovering lead from soil.

First the soil bearing the lead shot is collected, and this is most easily achieved by running an earth scraper over the area containing the lead shot. This machine has a blade which projects a few inches into the earth and as the machine moves over the earth the blade diverts the several uppermost inches of soil into a large bed on the machine. The earth scraper is a conventional piece of road building equipment and will not be described in further detail. The soil which is collected in the scraper is delivered to the earth shredder A where it is accumulated in a mound. This soil is dumped into the inlet 4 of the earth shredder by means of a front lift or some other similar type of earth moving equipment. The earth shredder A, in turn, breaks up large tightly compacted portions of the soil so that the soil is discharged onto the conveyor B in a fragmentized condition of relatively uniform size. The knives 8 of the shredder A are spaced sufficiently apart to enable the lead shot contained within the soil to pass between them. Hence, the lead shot passes through the shredder A without being damaged.

The conveyor B delivers the shredded soil to the inlet funnel 42 of the lead separator C, and that funnel directs the soil generally into the center of the agitating tank 34. This tank is filled with water which is continually supplied to the lower portion thereof through the several supply pipes 50 and 62. The water is delivered to the supply pipes 50 at considerable pressure, and this water discharges into the tank 34 such that a swirl is created within the tank 34. The water which is delivered to the supply pipe 62 is likewise under considerable pressure, and this water pressurizes the interior of the cross pipe 56 and escapes from the cross pipe 56 through the opening 38 at the bottom of the tank 34. Thus, an upwardly directed flow passes through the center of the whirlpool generated by the water issuing from the supply pipes 50. Furthermore, the vibrator units 46 impart substantial vibrations to the side walls 36 of the tank 34, and as a result the water against these side walls is likewise vibrated, creating additional turbulence within the tank 34.

Due to the turbulence within water of the tank 34, the shredded soil rapidly turns to mud, and any of the soil clinging to the lead shot is quickly dislodged. The turbulence keeps the mud in suspension and this suspension is generally in the upper end of tank 34 due to the upward flow of water through the tank 34. Indeed, the mud suspension flows over the upper edge of the weir 28 where it collects in the trough 30 surrounding the upper end of the tank 34.

The lead shot, on the other hand, being considerable heavier than the soil, drops downwardly through the upwardly flowing water and gravitates toward the opening 38 at the bottom of the tank 34. The shot is thoroughly cleansed as it passes through this zone of fresh water so that by the time the shot enters the cross pipe 56 it is completely free of mud. The shot drops through the cross pipe 56 and enters the discharge pipe 64 which directs it to the inlet port 70 of the screw conveyor 66. The conveyor 66 lifts the separated shot upwardly and discharges it through its outlet spout 72. Little if any water is lost through the spout 72 since it is located above the water line in the tank 34.

The mud suspension which overflows into the collecting trough 30 is delivered to the settling basin D through the discharge line 90 and pump 82 therein. Upon entering the settling tank 92 of the basin D, the water is stilled to the extent that the mud settles to the bottom of the tank 92 where it is withdrawn by the conveyor 102. That conveyor 102 delivers the mud to a mud pile located beyond its outlet spout 72.

The mud suspension enters the tank 92 on the opposite side thereof from the overflow trough 96 and before reaching the overflow trough 96 it must pass by the various baffles 98. Hence, by the time the water reaches the depressed edge of the tank 92 it has lost substantially all of the mud suspended therein. Consequently, clear water overflows into the trough 96, and this water is directed to the storage tank 110 from which it is withdrawn by the pump 116 for use again in the lead separator C.

While the apparatus of this invention is designed primarily for removing lead shot from soil, it may also be utilized to remove fragments of other metals from soil. For example, it is useful in removing fragments of iron, steel, brass, bronze and copper, to name a few.

This invention is intended to cover all changes and modifications of the example of the invention herein chosen for purposes of the disclosure which do not constitute departures from the spirit and scope of the invention.

What is claimed is:

1. A process for recovering metal from soil, said process comprising: shredding the metal-bearing soil to reduce it to fragments of generally small size; depositing the fragmentized metal-bearing soil into a swirling volume of water having a stream of water directed directly upwardly through the swirl from the bottom of the swirling volume, the swirling volume possessing sufficient turbulence to dislodge the soil from the metal; allowing the soil to form a suspension which rises to the top of the swirling volume; allowing the metal to gravitate to the bottom of the tank through the rising stream of water, so that the metal is cleansed; withdrawing the metal from the vicinity of the bottom of the tank by elevating it to an elevation at least about as high as the top surface of the volume of water and then discharging the metal; and allowing the suspension to overflow away from the swirling volume.

2. The process according to claim 1 and further comprising vibrating the suspension.

3. The process according to claim 1 and further comprising removing the suspension which overflows from the swirling volume and allowing the mud to settle out of the suspension.

4. The process according to claim 3 wherein the water which remains after the mud settles out of the suspension is added to the swirling volume to create more suspension.

5. An apparatus for separating metal from soil in which the metal is contained, said apparatus comprising an agitating tank adapted to be filled with water and having a tapered configuration with the small end of the tapered configuration being presented downwardly and the large end opening upwardly, the tank having an upper edge which forms a weir behind which the water is confined; a collecting trough at the upper end of the agitating tank and positioned to collect water which flows over the weir; an inlet funnel at the upper end of the tank for receiving metal-bearing soil, the funnel having its upper end above the weir on the tank and its lower end below the weir and within the interior of the tank, the inlet funnel having substantially the same taper as the tank and being presented inwardly from the tapered surfaces of the tank, the upper end of the inlet funnel being at least as wide as the upper end of the tank; a plurality of first water supply pipes connected to the tank below the lower end of the inlet funnel for discharging water into the tank, the first water supply pipes being arranged such that water introduced through the pipes will create a swirl within the tank; a second water supply pipe connected to the bottom of the tank below the location where the first supply pipes discharge into the tank such that a stream of water is directed directly upwardly into the tank from the bottom thereof with the stream being generally centered with respect to the tank and passing into the center of the swirl generated by the water discharged from the first pipes; whereby metal-bearing soil which is deposited into the inlet funnel will enter the swirling water in the tank and will be converted into a mud suspension which will rise upwardly and overflow into the collecting trough, while the metal will pass downwardly, through the upwardly directed stream where it is cleansed; and withdrawal means connected to the lower end of the agitating tank and extending upwardly therefrom for continuously withdrawing the separated metal from the vicinity of the lower end of the agitating tank, the withdrawal means elevating the metal to an elevation above the major portion of the agitating tank before discharging it.

6. An apparatus according to claim 5 and further comprising means for vibrating the sidewalls of the tank.

7. An apparatus according to claim 5 wherein the withdrawal means is a screw-type conveyor having an upper outlet spout above the upper edge of the tank.

8. An apparatus according to claim 5 and further comprising a settling tank connected with the collecting trough such that the mud suspension which enters the collecting trough is delivered to the settling tank, the settling tank being configured to cause the mud to settle out of the suspension and collect at the bottom of the tank.

9. An apparatus according to claim 8 and further comprising means for withdrawing the water which remains in the settling tank after the mud has settled out of the suspension and for forcing that water into the first and second water supply pipes.

10. An apparatus according to claim 5 wherein the settling tank has baffles extended through it to still the mud suspension introduced into it and means for withdrawing the mud which collects in the bottom of the settling tank, said last named means elevating the mud exteriorly of the settling tank.

11. An apparatus according to claim 5 and further comprising a shredder for fragmentizing the metal-bearing soil, and means for transferring the fragmentized soil from the shredder to the inlet funnel.

12. An apparatus according to claim 11 wherein the means for transferring the fragmentized soil comprises a conveyor having feed and discharge ends, an endless conveyor belt extended between its ends, the feed end of the conveyor being located beneath the shredder to receive the fragmentized soil discharge from the shredder, the discharge end of the conveyor being located above the inlet funnel for the tank such that the fragmentized soil is deposited in the inlet funnel, and means for moving the belt.

13. An apparatus according to claim 5 wherein the tank is in the shape of a four-sided pyramid.

14. An apparatus for separating metal from soil in which the metal is contained, said apparatus comprising: an agitating tank adapted to be filled with water and having a tapered configuration with the small end of the tapered configuration being presented downwardly and the large end opening upwardly, the tank having an upper edge which forms a weir behind which the water is confined; a collecting trough at the upper end of the agitating tank and positioned to collect water which flows over the weir; an inlet funnel at the upper end of the tank for receiving metal-bearing soil, the funnel having its upper end above the weir on the tank and its lower end below the weir and within the interior of the tank; a shredded into which the metal-bearing soil is introduced, the shredder having the capability of fragmentizing the soil; transfer means between the shredder and the inlet funnel for transferring the fragmentized metal-bearing soil from the shredder to the inlet funnel; a plurality of first water supply pipes connected to the tank below the lower end of the inlet funnel for discharging water into the tank, the first water supply pipes being arranged such that water introduced through the pipes will create a swirl within the tank; a second water supply pipe connected to the bottom of the tank below the location where the first supply pipes discharge into the tank such that a stream of water is directed directly upward into the tank from the bottom thereof with the stream being generally centered with respect to the tank and passing into the center of the swirl generated by the water discharged from the first pipes; whereby metal-bearing soil which is deposited into the inlet funnel will enter the swirling water in the tank and will be converted into a mud suspension which will rise upwardly and overflow into the collecting trough, while the metal will pass downwardly, through the upwardly directed stream where it is cleansed; and withdrawal means connected to the lower end of the agitating tank and extending upwardly therefrom for continuously withdrawing the separated metal from the vicinity of the lower end of the agitating tank, the withdrawal means elevating the metal to an elevation above the major portion of the agitating tank before discharging it.

15. An apparatus according to claim 14 and further comprising a settling tank connected with the collecting trough such that the mud suspension which enters the collecting trough is delivered to the settling tank, the settling tank being configured to cause the mud to settle out of the suspension and collect at the bottom of the tank.

* * * * *